US005690481A

United States Patent [19]

Eckerle

[11] Patent Number: 5,690,481

[45] Date of Patent: Nov. 25, 1997

[54] INTERNAL-GEAR MACHINE HAVING A DIVIDED FILLING PORTION

[75] Inventor: Otto Eckerle, Malsch, Germany

[73] Assignee: Eckerle Industrie-Elektronik GmbH, Malsch, Germany

[21] Appl. No.: 633,782

[22] PCT Filed: Oct. 21, 1994

[86] PCT No.: PCT/DE94/01249

§ 371 Date: Apr. 18, 1996

§ 102(e) Date: Apr. 18, 1996

[87] PCT Pub. No.: WO95/12070

PCT Pub. Date: May 4, 1995

[30] Foreign Application Priority Data

Oct. 29, 1993 [DE] Germany ..... 43 36 966.9

[51] Int. Cl.[6] ..... F01C 1/10

[52] U.S. Cl. ..... 418/126; 418/170

[58] Field of Search ..... 418/126, 169, 418/170

[56] References Cited

U.S. PATENT DOCUMENTS

| | | | |
|---|---|---|---|
| 2,482,713 | 9/1949 | Jones | 418/126 |
| 3,890,066 | 6/1975 | Eckerle | 418/216 |
| 4,472,123 | 9/1984 | Eckerle et al. | 418/126 |

FOREIGN PATENT DOCUMENTS

| | | | |
|---|---|---|---|
| 2533646 | 2/1977 | Germany . | |
| 2614048 | 10/1977 | Germany | 418/126 |
| 2924751 | 1/1981 | Germany . | |
| 2954546 | 5/1981 | Germany . | |
| 3047609 | 9/1981 | Germany . | |
| 3544857 | 6/1987 | Germany . | |
| 3723557 | 1/1989 | Germany . | |
| 4028699 | 4/1991 | Germany . | |

*Primary Examiner*—John J. Vrablik

*Attorney, Agent, or Firm*—Woodbridge & Associates

[57] ABSTRACT

Described is an internal-gear machine (10) comprising a casing (12, 80) in which there are provided an internally toothed annular gear (20), an externally toothed pinion (24) in engagement therewith, and a filling portion (28) which is divided into two in the space (14) between the annular gear (20) and the pinion (24). The filling portion parts (32, 34) are provided with openings (56, 58) which start from the common separation surface (30) and which are each provided with an inclined surface (60, 62) that is parallel to the axis, in such a way that the two inclined surfaces (60, 62) which face towards each other form with each other wedge surfaces which include a wedge angle. Bearing against the wedge surfaces is a respectively associated sealing roller (64) which is pressed against the associated wedge surfaces by means of a spring element (88). In order to provide a resilient springing characteristic which is as soft as possible and thereby to afford optimum stabilization in respect of the radial forces involved and a considerable reduction in noise, it is proposed that the corresponding spring element (88) is fixed with a fixing portion (92) to a securing portion (96) of the casing. A spring portion (90) of the corresponding spring element (88) projects away from the fixing portion (92), said spring portion being oriented at least approximately parallel to the axis and pressing against the associated sealing roller (64).

33 Claims, 4 Drawing Sheets

Figure 1:
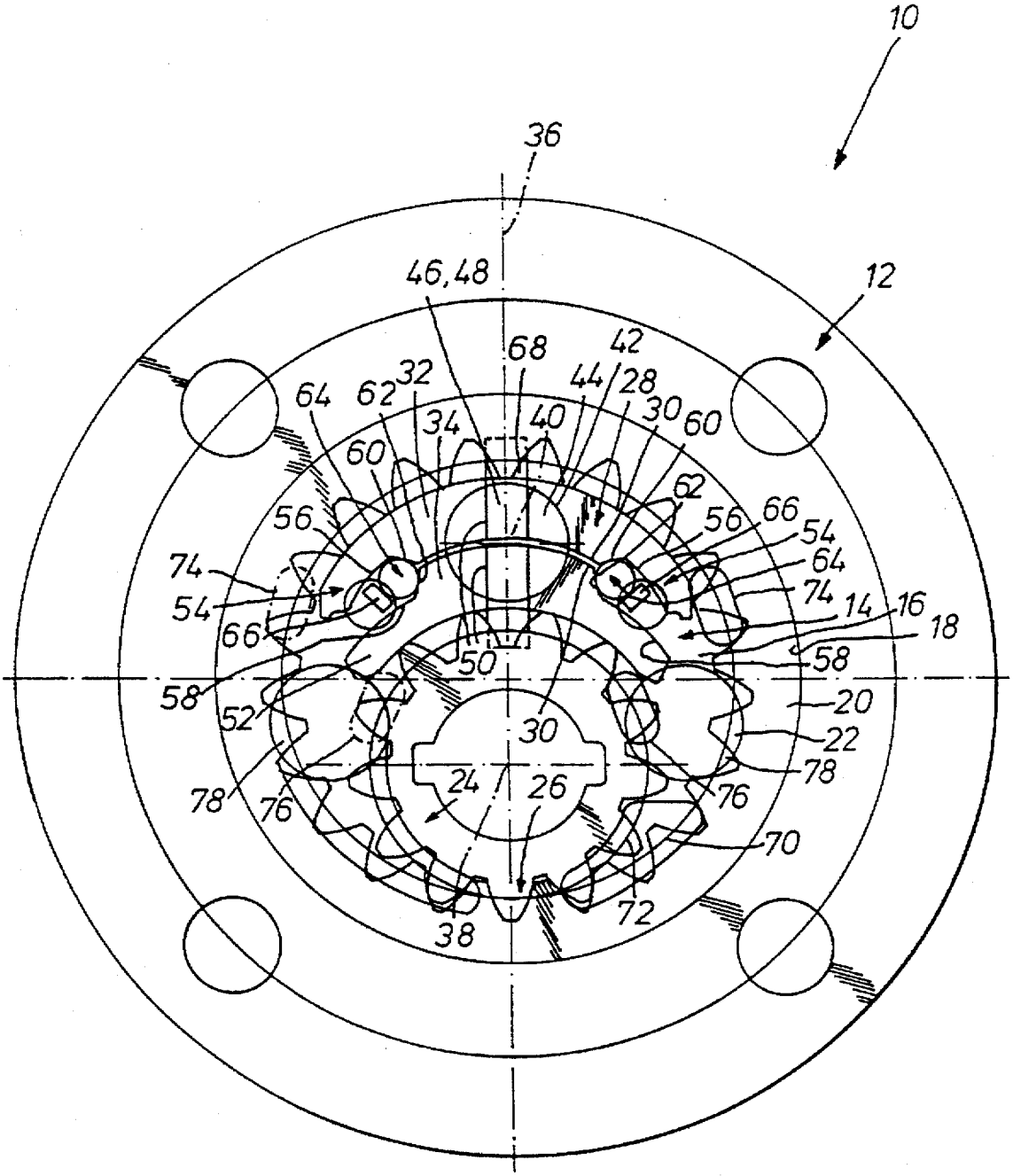

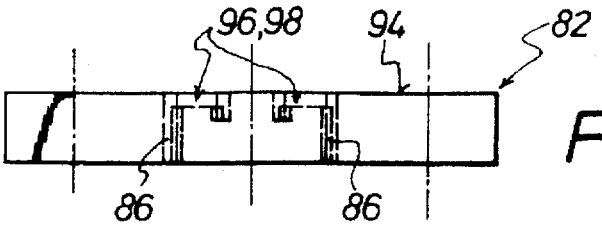
FIG. 3
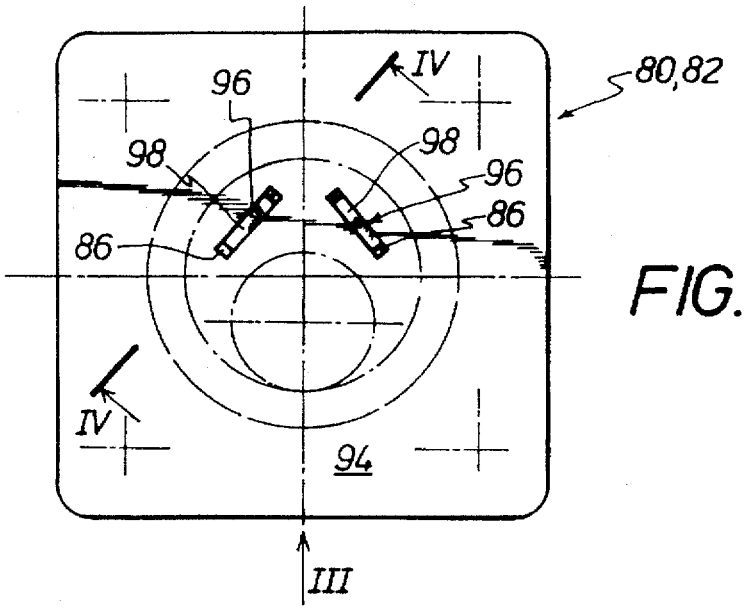
FIG. 2
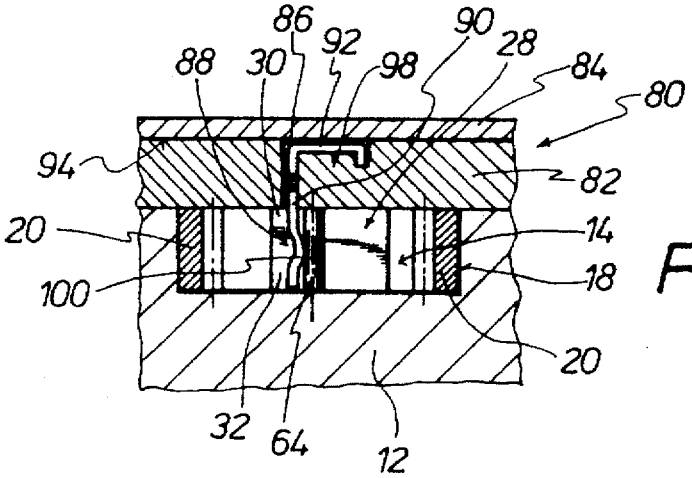
FIG. 4
FIG. 5A
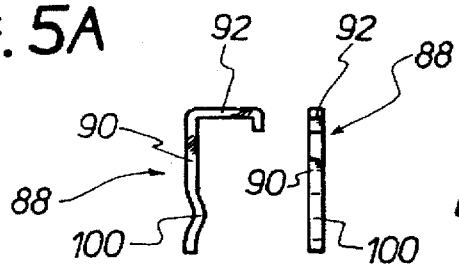
FIG. 5B

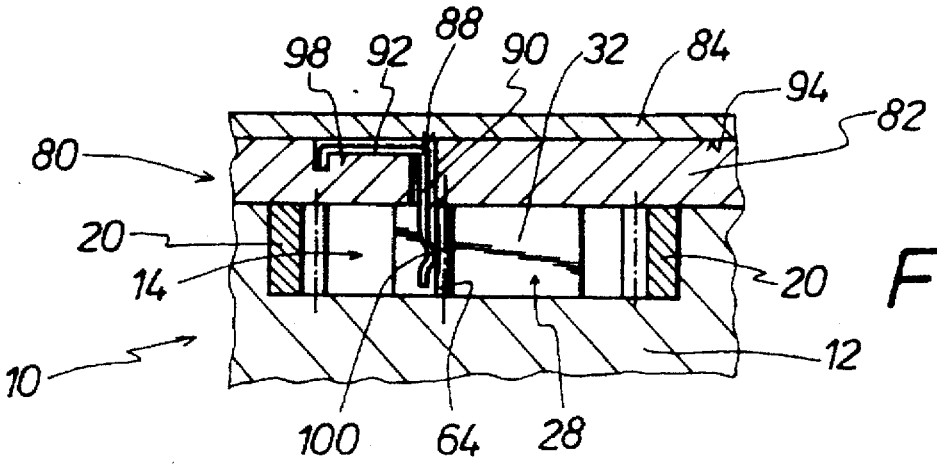
FIG. 6
FIG. 7A
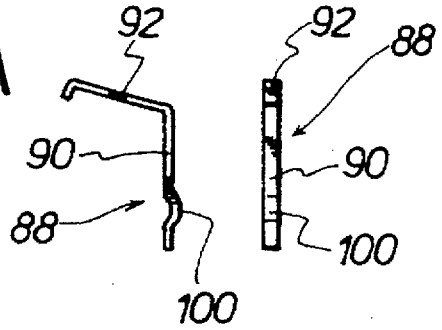
FIG. 7B
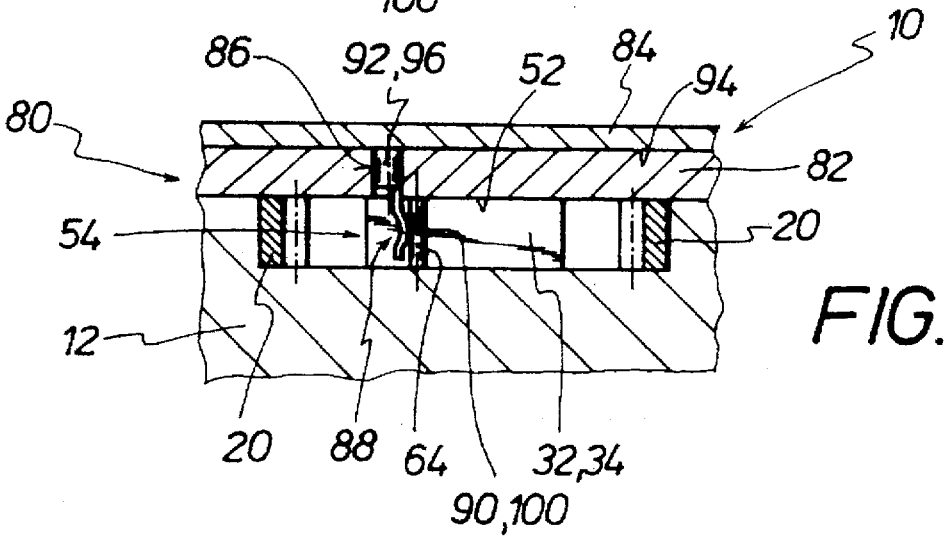
FIG. 8
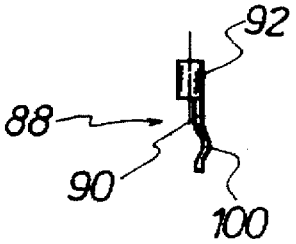
FIG. 9

INTERNAL-GEAR MACHINE HAVING A DIVIDED FILLING PORTION

The invention concerns an internal-gear machine, in particular an internal-gear pump.

Such an internal-gear machine with a filling portion which is divided into two filling portion parts along a separation surface is known for example from DE 29 54 546 C2. In that arrangement the filling portion is in the shape of half a sickle. The openings which extend from the separation surface of the filling portion in that known internal-gear machine are of such a configuration that the wedge surfaces of the two openings are oriented in the same direction, that is to say in a direction from the pressure side to the suction intake side of the internal-gear machine. The spring elements which are used in that known internal-gear machine are in the form of singly cambered or corrugated leaf springs, and they are at most of a longitudinal dimension which corresponds to the thickness of the filling portion. Spring elements of that kind not only have a relatively hard springing characteristic in particular as a result of the low degree of curvature or corrugation, but in particular also the arrangement thereof in the openings or in the residual space in each opening which is correspondingly reduced by the presence of the respective sealing roller therein is very expensive, which must be considered as a disadvantage.

A similar internal-gear machine, that is to say an internal-gear machine having a filling portion which is in the form of half a sickle and which is divided into two filling portion parts along a separation surface extending substantially in the peripheral direction is also known from DE 29 42 417 C2. That known internal-gear machine also provides that mutually oppositely disposed openings extend from the separation surface; in those openings, the inclined surfaces which form the wedge surfaces are oriented in the same direction, that is to say from the pressure chamber to the suction chamber of the internal-gear machine. In regard to the configuration and fitting of the spring elements, the points set forth above in relation to DE 29 54 546 C2 also correspondingly apply to that known internal-gear machine, that is to say in that case also the arrangement affords only a relatively hard springing characteristic, as well as involving the shortcoming of a considerable amount of time being required in fitting of the spring elements in the receiving space for the associated spring element, such space being reduced by virtue of the presence of the corresponding sealing roller. A relatively hard springing characteristic of that kind also has a corresponding effect on the service life and on the running qualities of the internal-gear machine.

DE 37 23 557 A1 also discloses an internal-gear machine with a filling portion of a half-sickle shape, which is divided into two filling portion parts along a separation surface extending substantially in the peripheral direction. In that known internal-gear machine the filling portion of the half-sickle shape is supported rotatably and displaceably on the casing by at least one mounting trunnion or filling portion pin mounted rotatably in a bore in the casing, and a mounting body which is displaceable in a groove, wherein said mounting trunnion is arranged at a spacing from the end of the filling portion which is towards the suction chamber, the mounting body projects from the mounting trunnion and engages into a groove in one of the side or bottom surfaces of the filling portion.

An internal-gear machine with a filling portion in the form of a half sickle, which is divided into two filling portion parts along a separation surface extending substantially in the peripheral direction is also known from DE 35 44 857 A1. The filling portion parts bear with their end faces at the suction side against a support surface of a support element which axially passes through the space between the internally toothed annular gear and the externally toothed pinion, in such a way that the filling portion parts are displaceable in a radial direction on the support surface and pivotable about a pivot axis which extends parallel to the axis of the pinion. In that configuration of the internal-gear machine, the support element is said to be fixedly connected to a wall of the casing and in addition the end faces of the filling portion parts are to involve a concave curvature, with a curvature axis which extends parallel to the pivot axis.

An internal-gear machine with an internally toothed annular gear which has substantially radial openings therethrough which connect the outside periphery of the annular gear to the inside thereof in the region of the gape between the teeth and the tips of the teeth is known from DE 38 05 186 A1. In that machine, the openings which open into the gaps between the teeth are each displaced into the non-load-bearing tooth flank which defines the tooth gap on one side, to such an extent that at the seine time it forms a connection between the tooth tip and the tooth root thereof. That known internal-gear machine, like the gear machines known from the above-discussed publications, is designed with a filling portion in the shape of half a sickle. All those internal-gear machines with a filling portion in the shape of half a sickle or with a filling portion which is divided into filling portion parts along a substantially peripherally extending separation surface can only be driven in one direction of rotation.

In comparison therewith German laid-open application (DE-OS) No 25 33 646 describes an internal-gear machine in which the filling portion can be of a sickle-like shape in order thereby to provide a reversible machine, in particular a pump.

The object of the present invention is to provide an internal-gear machine of the kind set forth in the opening part of this specification, in which the spring elements are comparatively resilient and are of a relatively low level of hardness, while in addition assembly of the spring elements is possible in a simple fashion and with a time saving.

By virtue of the fact that the corresponding spring element is fixed to at least one of the two casing parts with a fixing portion, it is possible in a simple and time-saving manner for the corresponding spring element to be reliably fixed to the casing and for example only thereafter for the associated sealing roller to be arranged in the receiving space defined by the wedge surfaces or the openings. The internal-gear machine according to the invention is therefore comparatively assembly-friendly.

An internal-gear machine of that kind which has a symmetrical sickle-shaped filling portion and in which the sickle-shaped filling portion is divided into two filling portion parts along a separation surface which extends substantially in the peripheral direction, wherein the filling portion parts have wedge surfaces whose wedge tips or edges face towards each other, affords a pressure compensation and reversibility effect with the advantages already mentioned above of simple and time-saving assembly not only in respect of the sealing rollers but in particular also the spring elements which are associated with the sealing rollers.

In accordance with the invention, a comparatively elastic and soft springing characteristic can be achieved if the corresponding spring element is fixed to the at least one casing part in such a way that the spring portion of the corresponding spring element comprises a spring length which is adapted to the thickness of the filling portion or to the axial length of the associated sealing roller. In the internal-gear machine according to the invention, the spring length may also be greater than the thickness of the divided filling portion or the axial length of the associated sealing roller. In that way, in comparison with the cambered or corrugated leaf springs used hitherto, it is possible to achieve a comparatively elastic and soft springing characteristic so that the internal-gear machine according to the invention is excellently suited in particular as an internal-gear pump for low and medium pressures.

In the internal-gear machine according to the invention the corresponding spring element can press with its spring portion against the outside peripheral surface of the associated sealing roller. It is however also possible for the corresponding spring element to extend with its spring portion into an internal space in the associated sealing roller and to press against a contact portion of the internal space. While, in the case of the first-mentioned configuration with a spring portion which presses against the outside peripheral surface of the sealing roller, it is necessary for the corresponding sealing roller and the associated spring element to be assembled separately and independently of each other, it is possible in the case of the last-mentioned design configuration for the corresponding spring element to be combined with the associated sealing roller outside the machine and for the structural unit consisting of the spring element and the associated sealing roller then to be arranged in the machine.

A comparatively great spring length for the spring portion of the corresponding spring element and thus a relatively elastic and soft spring characteristic for said spring element can be achieved if in accordance with the invention the corresponding spring element is stationarily fixed with its fixing portion to a securing portion of one of the two casing parts, wherein the fixing portion or the associated securing portion is axially set back with respect to the associated sealing roller and a motion space for the spring portion adjoins the securing portion, in the direction towards the sealing roller. In accordance with the invention, to afford a corresponding, comparatively great free spring length for the spring portion of the corresponding spring element, it is also possible for the corresponding spring element to be stationarily fixed with its fixing portion to a securing portion of one of the two housing parts, wherein the fixing portion or the associated securing portion immediately adjoins the associated sealing roller, and the spring portion projects with its end portion remote from the fixing portion into a motion space which is provided on the other of the two housing parts. Both in the first-mentioned and also in the last-mentioned case, it is possible to provide a respective spring element with a free spring length in respect of its spring portion, which at least corresponds to or which is even somewhat larger than the thickness of the filling portion or the length, which is adapted thereto, of the associated sealing roller. In that way it is possible to provide a spring element having a high degree of elasticity and a comparatively soft springing characteristic so that the internal-gear machine according to the invention is highly suited for example as an internal-gear pump for low and medium pressures, as has already been mentioned.

A further advantage of the internal-gear machine according to the invention is that, in accordance with the invention, the spring element comprising the spring portion and the fixing portion adjoining same is comparatively large in comparison with the known spring elements in the form of curved or corrugated small leaf springs, so that it can also be handled better than a known small leaf spring.

Desirably, in the internal-gear machine according to the invention, the casing part which holds the corresponding spring element can have on its inside a base portion and on its outside a cover portion, wherein the base portion has a through hole forming a motion space for the corresponding spring element and the corresponding spring element is secured with its fixing portion between the base portion and the cover portion. When the gear machine according to the invention is of such a design configuration, it may be advantageous for said base portion to be designed for example as a sintered portion directly with the through holes for the spring elements which are operative in at least approximately oppositely directed directions.

In the case of an internal-gear machine of the last-mentioned kind, in accordance with the invention, simple and reliable fixing of the corresponding spring element can be achieved if the base portion, at its outside surface which is towards the cover portion, is provided with a groove which forms the securing portion for the corresponding spring element, which groove adjoins the associated through hole, and if the fixing portion of the corresponding spring element includes an angle that differs from 90°, with the spring portion of the spring element, in the unloaded original condition. The spring portion can project from the fixing portion at an obtuse or acute angle which differs from 90°. By virtue of that arrangement it is possible to set as desired in each case a suitable mechanical prestressing for the spring element and thus a setting in respect of the spring force with which the spring element or the spring portion of the spring element presses against the associated sealing roller.

A further simplification in terms of handling and in particular assembly of the spring element can be achieved if the spring element is in one piece with a motion portion from which there project at the end two spring portions which in the unloaded original condition respectively include an angle that differs from 90°, with the common central securing portion. That angle which differs from 90° is desirably an acute angle, that is to say an angle which is less than 90°. In the case of such a one-piece spring element with two spaced-apart spring portions and a central fixing portion which connects the two spring portions together, it is desirable if the securing portion is at least approximately matched to the configuration of the separation surface of the two filling portion parts. That matching effect usually involves an angularly extending matching configuration, that is to say the fixing portion is of a suitably angled configuration.

From the point of view of reducing wear and quietness of operation of the internal-gear machine according to the invention, it has been found advantageous if the two filling portion parts of the sickle-shaped symmetrical filling portion have a respective opening at at least one of their two base surfaces which face away from each other, and if at least one filling portion pin is rotatably mounted in the corresponding casing part, which is provided at its end with a raised portion which fits in terms of shape with a sliding fit into the two openings in the corresponding base surfaces of the two filling portion parts. More specifically, that arrangement not only permits corresponding limited mobility of the filling portion parts in their peripheral or longitudinal direction by virtue of corresponding rotary movement of the filling portion pin, but at the same time it also permits movement of the filling portion parts in the radial direction along said raised portion of the filling portion pin.

In the case of an internal-gear machine of the last-mentioned kind, it is desirable if the openings are provided in the longitudinal centre, forming an axis of symmetry, of the corresponding sickle-shaped base surface of the two filling portion parts, and form a common groove, and if the raised portion which projects at the end away from the at least one filling portion pin is in the form of a rib which is adapted to the groove. Hare the groove is desirably of a trapezoidal cross-section which enlarges towards the open side; the rib is of a corresponding trapezoidal cross-section which correspondingly tapers away from the filling portion pin. By virtue of that arrangement the filling portion parts can be fitted into the interior of the machine which is between the internally toothed annular gear and the externally toothed pinion, in a simple manner which does not take up a great deal of time. For the purposes of stabilising the radial forces which occur in operation of the internal-gear machine according to the invention and for a further reduction in the noise Generation or level of noise which occurs in operation, it has proven desirable if at least one of the casing parts is provided at its inside surface and/or if the two filling portion parts are provided at at least one of their two base surfaces which face away from each other, with at least one pressure compensation passage which extends between the circular tooth ring of the internally toothed annular Gear and the circular tooth ring of the externally toothed pinion. Said pressure compensation passage can therefore be provided on one of the two casing parts of the machine according to the invention, but it is also possible for the two casing parts each to be provided with at least one respective pressure compensation passage of that kind. It is expedient for the same purpose, that is to say stabilisation of the radial forces which occur in operation of the machine and for a further reduction in noise, if, in the internal-gear machine according to the invention, at least one of the casing parts is provided with pre-filling openings at its inside in the region of the circular tooth ring of the internally toothed annular gear and/or in the region of the circular tooth ring of the externally toothed pinion.

The internal-gear machine according to the invention has inter alia the following advantages: the gap losses are slight, thus resulting in an increase in the level of efficiency; the temperature dependency is negligibly low so that the machine can be operated even at high temperatures; the assembly of all individual parts, that is to say putting the machine according to the invention together, is possible in a simple and time-saving manner; a small amount of noise is generated; and the two-part configuration of the filling portion means that a relatively large number of teeth of the pinion and the annular gear bear against the respectively associated filling portion part.

Figure 10:
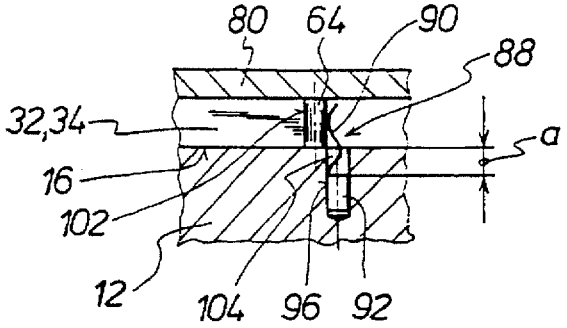
Figure 11:
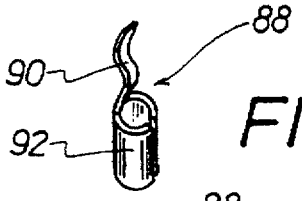
Figure 12:
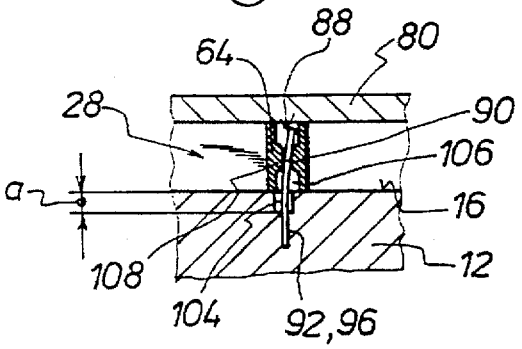
Figure 13:
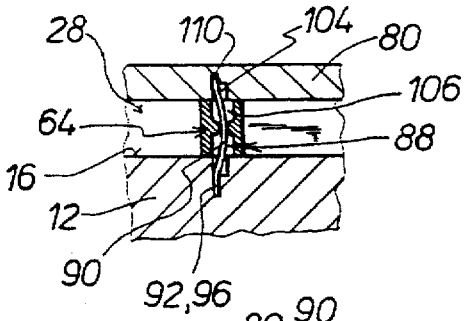
Figure 14:
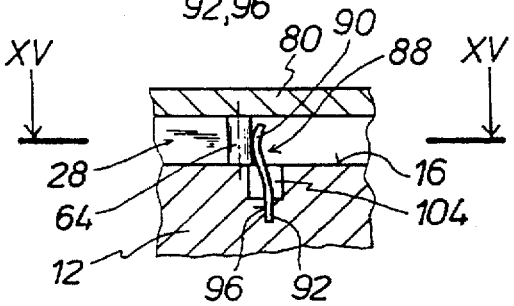
Figure 15:
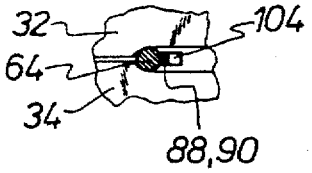

Further details, features and advantages are apparent from the following description of an embodiment, illustrated in the drawing, of the internal-gear machine according to the invention, in particular an internal-gear pump, which is suitable as a reversible internal rotor in particular for low and medium pressures, and alternative configurations of spring elements and the arrangement thereof in the internal-gear machine according to the invention. In the drawing:

FIG. 1 is a view from above and from the front of an internal-gear machine, with the second casing part removed from the one casing part, in order clearly to show the internally toothed annular gear which is rotatably mounted in said one casing part, the externally toothed pinion which is in engagement with the annular gear, the two-part filling portion in the space between the annular gear and the pinion, and further details of the machine, FIG. 2 is a plan view of a base portion of a casing or cover part, FIG. 3 is a side view of the base portion viewing in the direction of the arrow III in FIG. 2, FIG. 4 is a view in section taken along section line IV—IV in FIG. 2 through a portion of the machine, that is to say through the one casing part which forms a main part, as well as through the base portion and a cover portion which jointly form the second casing part or a cover respectively, for illustrating a configuration and arrangement of the spring element which presses against an associated sealing roller, FIGS. 5 and 5*a* show a front view and a side view of the spring element shown in FIG. 4, FIG. 6 is a sectional view similar to FIG. 4 showing a part thereof to illustrate another configuration and arrangement of a spring element, FIGS. 7 and 7*a* shows the spring element of FIG. 6 in the unloaded original condition viewing from the front and from the side, FIG. 8 is a sectional view similar to FIG. 4 or FIG. 6 showing part thereof to illustrate a third configuration and arrangement of a spring element which presses against an associated sealing roller, FIG. 9 shows a side view of the spring element shown in FIG. 8, FIG. 10 is a view of a portion of a spring element which presses against a sealing roller, similarly to the spring elements shown in FIGS. 8 and 9, FIG. 11 is a perspective view of the spring element shown in FIG. 10, FIG. 12 is a view similar to FIG. 10 to show another configuration of the spring element and a further configuration of the sealing roller with which the spring element co-operates, FIG. 13 is a view similar to FIGS. 10 and 12 to show a third embodiment of the spring element which co-operates with a sealing roller, FIG. 14 is a view similar to FIGS. 10, 12 and 13 of a further embodiment of the spring element which co-operates with a sealing roller, and FIG. 15 is a view in section taken along line XV—XV in FIG. 14.

FIG. 1 shows in an opened condition an embodiment of the internal-gear machine 10 which in particular can be a reversible internal-gear pump. The internal-gear machine 10 has two casing parts of which the one casing part 12 which forms a main or base part is shown while the second casing part which forms a cover part for sealingly closing the base part or the first casing part 12 is not shown in this Figure. The first casing part 12 is provided with an opening 14 defined by a circular inside surface 16 and a circular-cylindrical peripheral surface 18. Rotatably provided in the opening 14 is an annular gear 20 provided with an internal tooth configuration 22. A pinion 24 is in meshing engagement with the internally toothed annular gear 20. The pinion 24 has an external tooth arrangement 26 corresponding to the internal tooth arrangement of the annular gear 20.

Provided in the space 14 which remains between the internally toothed annular gear 20 and the externally toothed pinion is a sickle-shaped filling portion 28 which is of a thickness corresponding to the pinion 24 and the annular gear 20. The filling portion 28 is subdivided into two filling portion parts 32 and 34 along a separation surface 30 which extends approximately in the peripheral direction. The filling portion 28 or the two filling portion parts 32 and 34 are of a symmetrical configuration relative to a centre line 36. That centre line 36 is defined by the centre 38 of the driven pinion 24 and the centre 40 of a filling portion pin 42. The portion pin 42 is rotatably mounted in the casing part 12, its end face 44 which terminates flat with the inside surface 16 of the space 14 is provided with a raised portion 48 which is in the form of a rib 46 and which projects in positively looking relationship into openings 50 which are adapted thereto in respect of shape and which are provided in the base surface 52, which is towards the filling portion pin 42, of the two filling portion parts 32 and 34. That provides for limited radial mobility of the filling portion parts 32, 34 in relation to each other and in relation to the internally toothed annular gear 20 and the externally toothed pinion 24 respectively.

At their end portions 54 which face away from each other the two filling portion parts 32 and 34 are provided with openings 56 and 58 which extend from the separation surface 30, each of the openings 56, 58 having a respective inclined surface 60 and 62 respectively. The respectively associated inclined surfaces 60 and 62, which are disposed laterally in opposite relationship in relation to the separation surface 30, of each of the two end portions 54 of the two-part filling portion 28, form wedge surfaces, against each of which a respective sealing roller 64 sealingly bears. Each of the two sealing rollers 64 is urged by means of an associated spring element 66 against the corresponding inclined or wedge surface 60, 62. Configurations of such spring elements 66 and the arrangement thereof on the casing part 12 or on the second cover or casing part which is not shown in FIG. 1 are illustrated in FIGS. 2 through 15 and are described in greater detail hereinafter with reference to those Figures.

For the purposes of stabilisation of the radial forces occurring in operation of the machine 10 and for a reduction in the production of noise, the casing part 12 and/or the second casing pert forming a cover can be provided at its inside surface 16 with at least one pressure compensation passage 68 which extends between the circular tooth ring 70 of the internal tooth arrangement of the annular gear 20 and the circular tooth ring 72 of the external tooth arrangement of the driven pinion 24. It will be appreciated that it is also possible for the filling portion parts 32 and 34 of the filling portion 28 to be provided with a corresponding pressure compensation passage 68 in order to provide for a corresponding pressure compensation effect between the two tooth arrangements 22 and 26.

Provided for the sane purpose, that is to say stabilisation of the radial forces and reducing the level of noise, are pre-filling openings 74 and 76 which are provided for example in the inside surface 16 of the casing part 12 and/or in the corresponding inside surface of the second casing part in the region of the circular tooth ring 70 of the internal tooth arrangement 22 of the annular gear 20 and in the region of the circular tooth ring 22 of the external tooth arrangement 16 of the pinion 24.

Reference numeral 78 in FIG. 1 denotes an inlet and an outlet respectively which, according to the respective direction of rotation of the pinion 24 and the annular gear 20, provide an intake into a suction chamber or a discharge from the oppositely disposed pressure chamber.

FIG. 2 is a plan view of a base portion 82 which, jointly with a cover portion 84 (see for example FIG. 4), forms a second casing part 80. As can also be seen from FIG. 3, the base portion 82 has two through holes 86 which for a respectively associated spring element 88 (see FIGS. 4 and 5) or for the spring portion 90 of the corresponding spring element 88, form a motion space in which the corresponding spring portion 90 can resiliently move. Integrally connected to the spring portion 90 is a fixing portion 92 with which the corresponding spring element 88 is secured to the associated casing part 80. For that purpose the base portion 82 is desirably provided at its main surface 94 which is towards the cover portion 84, with a groove 98 which forms a securing portion 96 and which directly adjoins the associated through hole 86. Such a configuration, as is shown in FIG. 2 through 5, has the advantage that the corresponding spring element 88 can be easily assembled from the cover side, that is to say from the side of the second casing part 80, insofar as, after arranging the externally toothed pinion, the internally toothed annular gear 20 and the filling portion 28, that is to say the filling portion parts 32 and 34 and the corresponding sealing rollers 64, in the space 14 of the first casing part 12, in a first assembly step, the base portion 82 is mounted on the first casing part 12, whereafter then the two spring elements 88 can be easily inserted with their spring portion 90 through the respectively associated through hole 86 until the fixing portion 92 of the corresponding spring element 88 is positioned in the securing portion 96 of the base portion 82. Thereafter the cover portion 84 is fixed on the base portion 82, whereby the corresponding spring element or the two spring elements 88 with the associated fixing portion 92 are fixed in the securing portion 96.

In the embodiment shown in FIGS. 2 through 5, each spring element 88, in the original condition, is of such a shape that the spring portion 90 includes, with the adjoining fixing portion 92, an angle which is less than 90°, or the spring portion 90 is provided with a curvature portion 100 which bears against the associated sealing roller 64, as can be seen from FIGS. 4 and 5.

FIGS. 6 and 7 show a further possible form of assembly of a spring element 88 (FIG. 6) or a second configuration of the spring element 88 (FIG. 7), the same details as in FIGS. 4 and 5 being identified by the same reference numerals as therein, so that there is no need for all those details to be described once again in detail, in connection with FIGS. 6 and 7. The essential difference in the configuration shown in FIGS. 6 and 7 in comparison with the embodiment shown in FIGS. 4 and 5 is that the fixing portion 92 of the spring element 88 includes an obtuse angle that differs from 90°, with the spring portion 90, when in the unloaded original condition (see FIG. 7), so that in the assembled condition as shown in FIG. 6 of the internal-gear machine 10 of which a part is shown therein, the spring portion 90 of the spring element 88 presses with a suitable spring force against the associated sealing roller 64.

FIG. 8 is a sectional view similar to FIGS. 4 and 6 respectively showing part of the arrangement of a further configuration of the spring element 88 in an internal-gear machine 10 of which a portion is illustrated, wherein—as can be seen from FIG. 9—the spring element 88 has a fixing portion 92 and a spring portion 90 aligned therewith. The spring portion 90 is in this case also provided with a curvature portion 100 which bears against the associated sealing roller 64 or urges said sealing roller 64 against the inclined surfaces 60 and 62 forming wedge surfaces (see FIG. 1). In this embodiment of the machine the through hole 86 in the base portion 82 not only forms the securing portion 96 for the fixing portion 92 of the spring element 88 but at the same time also a corresponding motion space for the spring portion 90. That is achieved by virtue of the fact that the spring element 88 is axially set back with its fixing portion 92 relative to the base surfaces 52 and 54 respectively of the two filling portion parts 32, 34. In this configuration of the machine 10 it is also possible, as is readily apparent, for the spring elements 88 to be fitted from the cover side, which was not possible hitherto with the known internal-gear machines.

FIG. 10 is a partial diagrammatic view of a casing part 12, a filling portion part 32 which lies on the inside surface 16 of the casing part 12, a second casing part 80 which lies on the filling portion part 32 and which is provided for sealingly closing the first casing part 12, and a sealing roller 64 which is disposed between the two casing parts 12 and 80 and which is pressed by means of a spring element 88 against the inclined surface of the corresponding filling portion part or against the wedge surface formed by the corresponding inclined surfaces 60 and 62 (see FIG. 1). As is also clearly apparent from FIG. 11 the spring element 88 has a sleeve-shaped fixing portion 92 and a spring portion 90 which projects axially away from the fixing portion 92 and which for example is curved in a wave-like configuration. In that case the spring portion 90 presses against the outside peripheral surface 102 of the associated sealing roller 64. In order to provide a freely resilient spring portion 90 of maximum length, as shown in FIG. 10 the fixing portion 92 of the spring element 88 is axially set back relative to the associated sealing roller 64, as is indicated by the arrow a in FIG. 10. That arrangement affords a motion space 104 on the side towards the sealing roller 64, adjoining the securing portion 96 in the casing part 12 for fixing the fixing portion 92 of the spring element 88; the spring portion 90 of the spring element 88 can virtually freely move in the motion space 104. This however involves a corresponding increase in the free spring length so as to afford a spring element 88 of suitable elasticity and softness. The spring element 88 may for example comprise a sheet metal material of a wall thickness of about 0.5 mm, comprising CuSn6Zn.

While FIG. 10 shows a construction in which the spring element 88 bears with its spring portion 90 against the outside peripheral surface 102 of the corresponding sealing roller 64, FIG. 12 shows an embodiment in which the corresponding spring element 88 extends with its spring portion 90 into an internal space or cavity 106 in the associated sealing roller 64. The cavity 106 can be formed with a contact portion 106 against which the spring element 88 bears with its spring portion 90. FIG. 12 shows a spring element 88 in which the fixing portion 92 and the spring portion 90 more or less align with each other. In order also for such a configuration to provide a relatively great free spring length and thus a corresponding degree of elasticity end softness in terms of the spring characteristic, in this case also the securing portion 96, for fixing the fixing portion 92 of the spring element 88, is set back by the dimension a relative to the inside surface 16 of the casing part 12, forming a motion space 104. The two-part filling portion 28 bears against said inside surface 16 of the casing part 12. Reference numeral 80 in this Figure also identifies the second casing part which bears against the filling portion 28.

FIG. 13 shows a further possible arrangement of the corresponding spring element 88. In this case the spring element 88 is fixed with its fixing portion 92 in a securing portion 96 of the casing part 12, the securing portion 96 directly adjoining the inside surface 16 of the casing part 12. In order for this arrangement also to provide a comparatively great free spring length in respect of the spring portion 90 of the spring element 88, the spring element 88 projects with its end portion 110 which is remote from the fixing portion 92, into a motion space 104 on the second casing part 80. In the construction shown in FIG. 13 the spring element 88 extends through the cavity 106 of the corresponding sealing roller 64. In this case also reference numeral 28 denotes the two-part filling portion.

FIG. 14 shows a construction in which the casing part 12, starting from the inside surface 16, has a motion space 104 and, adjoining the motion space 104, a securing portion 96 in which the spring element 88 is fixed with its fixing portion 92. The spring element 88 is of a similar configuration to the spring elements 88 shown in FIGS. 12 and 13, that is to say adjoining the fixing portion 92 in at least approximately aligned relationship is a spring portion 90 which for example is of an arcuately curved configuration and which bears against or presses against the associated sealing roller 64. In this case also the motion space 104 involves a corresponding increase in the length of the movable spring portion 90 and accordingly that affords a corresponding degree of elasticity and softness of the springing characteristic of the spring element 88. The sealing roller 64 is therefore relatively softly and elastically pressed by means of the spring element 88 against the two-part filling portion 28 on which the second casing part 80 is arranged.

FIG. 15 is a sectional view of the sealing roller 64 and the spring element 88 which is urged against the sealing roller 64, or the spring portion 90 of the spring element 88.

I claim:

1. An internal-gear machine enclosed in a two part casing comprising:

an internally toothed annular gear;

an externally toothed pinion engaged with said internally toothed annular gear and defining a sickle shaped filling portion in the remaining space between said internally toothed annular gear and said externally toothed pinion;

first and second symmetrical sickle shaped filling portion parts situated within the filling portion and forming a separation surface which extends substantially in a peripheral direction, each filling portion part having mutually disposed openings at their respective ends, said openings beginning at the separation surface and extending angularly outward forming respective wedge surfaces;

first and second sealing rollers provided in the mutually disposed openings defined by the respective wedge surfaces, said first and second sealing rollers bearing against said first and second wedge surfaces respectively; and first and second spring elements comprising a fixing portion and a spring portion and fixed to one of the two casing parts, said first and second spring elements urging said first and second sealing rollers against said first and second wedge surfaces respectively.

2. An internal-gear machine according to claim 1 wherein said spring elements are respectively fixed to at least one casing part such that the respective spring portions comprise a spring length which is adapted to the thickness of the filling portion.

3. An internal-gear machine according to claim 1 wherein said spring elements are respectively fixed to at least one casing part such that the respective spring portions comprise a spring length which is adapted to the axial length of the associated sealing roller.

4. An internal-gear machine according to claim 2 wherein the respective spring elements press with their spring portions against the outside peripheral surface of their associated sealing roller.

5. An internal-gear machine according to claim 4 wherein the casing part which holds said spring elements comprises, on its inside, a base portion and, on its outside, a cover portion, wherein said base portion has a through hole forming a motion space for the corresponding spring element and the corresponding spring element is secured with its fixing portion between said base portion and said cover portion.

6. An internal-gear machine according to claim 4 wherein the spring elements are fixed with their fixing portions to respective securing portions of one of the two casing parts, wherein said fixing portions or their associated securing portions are axially set back with respect to their associated sealing rollers and a motion space for the spring portions adjoin the securing portions, in the direction towards said respective sealing rollers.

7. An internal-gear machine according to claim 4 wherein the spring elements are fixed with their fixing portions to respective securing portions of one of the two casing parts, wherein said fixing portions or their associated securing portions adjoin the associated sealing rollers, and that the spring portions project with their end portions remote from said fixing portions into a motion space which is provided on the other of the two casing parts.

8. An internal-gear machine according to claim 5 wherein at its outside surface which is towards the cover portion, the base portion is provided with a groove which forms the securing portion for the corresponding spring element, which groove adjoins the associated through hole, and that the securing portion of the corresponding spring element includes an angle that differs from 90°, with the spring portion of the spring element, in the unloaded original condition.

9. An internal-gear machine according to claim 8 wherein the spring element is in one piece with a fixing portion and with two end spring portions which in the unloaded original condition respectively include an angle that differs from 90°, with the common central fixing portion.

10. An internal-gear machine according to claim 9 wherein the fixing portion of the spring element is at least approximately adapted to the configuration of the separation surface of the two filling portion parts.

11. An internal-gear machine according to claim 10 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

12. An internal-gear machine according to claim 11 wherein at least one of the casing parts is provided with pre-filling openings at its inside surface in the region of the circular tooth ring of the internally toothed annular gear and/or in the region of the circular tooth ring of the extremely toothed pinion.

13. An internal-gear machine according to claim 6 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

14. An internal-gear machine according to claim 13 wherein at least one of the casing parts is provided with pre-filling openings at its inside surface in the region of the circular tooth ring of the internally toothed annular gear and/or in the region of the circular tooth ring of the extremely toothed pinion.

15. An internal-gear machine according to claim 7 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

16. An internal-gear machine according to claim 15 wherein at least one of the casing parts is provided with pre-filling openings at its inside surface in the region of the circular tooth ring of the internally toothed annular gear and/or in the region of the circular tooth ring of the extremely toothed pinion.

17. An internal-gear machine according to claim 3 wherein the corresponding spring element extends with its spring portion into an internal space in the associated sealing roller.

18. An internal-gear machine according to claim 17 wherein the casing part which holds the corresponding spring element has on its inside a base portion and on its outside a cover portion, wherein the bass portion has a through hole forming a motion space for the corresponding spring element and the corresponding spring element is secured with its fixing portion between the base portion and the cover portion.

19. An internal-gear machine according to claim 18 wherein at its outside surface which is towards the cover portion, the base portion is provided with a groove which forms the securing portion for the corresponding spring element, which groove adjoins the associated through hole, and that the securing portion of the corresponding spring element includes an angle that differs from 90°, with the spring portion of the spring element, in the unloaded original condition.

20. An internal-gear machine according to claim 19 wherein the spring element is in one piece with a fixing portion and with two end spring portions which in the unloaded original condition respectively include an angle that differs from 90°, with the common central fixing portion.

21. An internal-gear machine according to claim 20 wherein the fixing portion of the spring element is at least approximately adapted to the configuration of the separation surface of the two filling portion parts.

22. An internal-gear machine according to claim 21 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

23. A internal-gear machine according to claim 22 wherein at least one of the casing parts is provided with pre-filling openings at its inside surface in the region of the circular tooth ring of the internally toothed annular gear and/or in the region of the circular tooth ring of the extremely toothed pinion.

24. An internal-gear machine according to claim 17 wherein the corresponding spring element is fixed with its fixing portion to a securing portion of one of the two housing parts, wherein the fixing portion or the associated securing portion is axially set back with respect to the associated sealing roller and a motion space for the spring portion adjoins the securing portion, in the direction towards the sealing roller.

25. An internal-gear machine according to claim 24 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

26. A internal-gear machine according to claim 25 wherein at least one of the casing parts is provided with pre-filling openings at its inside surface in the region of the circular tooth ring of the internally toothed annular gear and/or in the region of the circular tooth ring of the extremely toothed pinion.

27. An internal-gear machine according to claim 17 wherein the corresponding spring element is fixed with its fixing portion to a securing portion of one of the two casing parts, wherein the fixing portion or the associated securing portion adjoins the associated sealing roller, and that the spring portion projects with its end portion remote from the fixing portion into a motion space which is provided on the other of the two casing parts.

28. An internal-gear machine according to claim 27 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

29. A internal-gear machine according to claim 28 wherein at least one of the casing is provided with pre-filling openings at its inside surface in the region of the circular tooth ring of the internally toothed annular gear and/or in the region of the circular tooth ring of the extremely toothed pinion.

30. An internal-gear machine according to claim 1 wherein at least one of their two base surfaces which face away from each other, the two filling portion parts respectively have an opening, and that at least one filling portion pin is rotatably mounted in the corresponding casing part, which is provided at its end with a raised portion which is positively locking and movably arranged in the two openings in the corresponding base surface of the two filling portion parts.

31. An internal-gear machine according to claim 30 wherein the two openings are provided on the longitudinal center, forming an axis of symmetry, of the corresponding base surface of the two filling portion parts, and form a common groove, and that the raised portion which projects at the end away from at least one filling portion pin is in the form of a rib which is adapted to the groove.

32. An internal-gear machine according to claim 31 wherein at least one of the casing parts is provided at its inside surface and/or the two filling portion parts are provided at least one of their two base surfaces which face away from each other, with at least one pressure compensation passage which extends between the circular tooth ring of the internally toothed annular gear and the circular tooth ring of the externally toothed pinion.

33. A internal-gear machine according to claim 32 wherein at least one of the casing parts is provided with pre-filling openings at its inside surface in the region of the circular tooth ring of the internally toothed annular gear and/or in the region of the circular tooth ring of the extremely toothed pinion.

* * * * *